US008807949B2

(12) United States Patent
Hammel et al.

(10) Patent No.: US 8,807,949 B2
(45) Date of Patent: Aug. 19, 2014

(54) RADIAL FAN WHEEL ARRANGEMENT

(75) Inventors: Christian Hammel, Pfedelbach-Oberohrn (DE); Erhard Gruber, Satteldorf (DE); Oliver Haaf, Obersulm (DE); Christian Haag, Mulfingen-Ailringen (DE); Michael Strehle, Ingelfingen (DE)

(73) Assignee: Emb-Papst Mulfingen GmbH & Co. KG, Mulfingen (DE)

( * ) Notice: Subject to any disclaimer, the term of this patent is extended or adjusted under 35 U.S.C. 154(b) by 406 days.

(21) Appl. No.: 13/046,833

(22) Filed: Mar. 14, 2011

(65) Prior Publication Data

US 2011/0223007 A1 Sep. 15, 2011

(30) Foreign Application Priority Data

Mar. 15, 2010 (DE) ..... 10 2010 011 526

(51) Int. Cl.
*F04D 29/66* (2006.01)

(52) U.S. Cl.
USPC ..... 416/144; 416/182; 416/186 R; 416/178

(58) Field of Classification Search
CPC ..... F04D 29/66; F04D 29/662; F04D 29/663; F04D 29/281
USPC ..... 416/178, 179, 181, 182, 186 R, 144
See application file for complete search history.

(56) References Cited

U.S. PATENT DOCUMENTS

| | | | | |
|---|---|---|---|---|
| 3,315,750 | A * | 4/1967 | Delaney | 416/144 |
| 3,512,222 | A * | 5/1970 | Tinnerman | 24/561 |
| 3,541,607 | A * | 11/1970 | Greene | 415/112 |
| 5,538,395 | A * | 7/1996 | Hager | 416/144 |
| 5,591,008 | A * | 1/1997 | Wrobel et al. | 416/144 |
| 5,927,947 | A * | 7/1999 | Botros | 416/144 |
| 6,156,090 | A * | 12/2000 | Ishikawa et al. | 55/471 |
| 6,530,747 | B1 * | 3/2003 | Schneider et al. | 416/144 |
| 8,353,670 | B2 * | 1/2013 | Glasspoole et al. | 416/144 |
| 2003/0198556 | A1 * | 10/2003 | Kim | 416/186 R |
| 2006/0236796 | A1 * | 10/2006 | Harada | 74/52 |
| 2008/0075596 | A1 * | 3/2008 | Kitamura | 416/145 |

FOREIGN PATENT DOCUMENTS

| | | | |
|---|---|---|---|
| DE | 41 36 293 | A1 | 11/1991 |
| DE | 198 45 501 | A1 | 10/1998 |
| DE | 10 2009 032 411 | A1 | 2/2010 |
| JP | 2002054594 | A * | 2/2002 |
| JP | 2008064044 | A * | 3/2008 |

OTHER PUBLICATIONS

DE 10 2009 032411 Machine Translation.*
European Search Report—Jan. 11, 2012.

* cited by examiner

*Primary Examiner* — Edward Look
*Assistant Examiner* — Wayne A Lambert
(74) *Attorney, Agent, or Firm* — Brinks Gilson & Lione

(57) ABSTRACT

A radial fan wheel arrangement includes a circular bottom plate (2) and a circular cover plate (3) with a central inflow opening (4), as well as wheel blades (6) running between the bottom plate (2) and the cover plate (3). Pocket-shaped recesses (9) are configured at least on one side of a plate surface in the space between the wheel blades (6) in an outer edge area of the cover plate (3) or the bottom plate (2) or both. At least one counterweight (13) is mounted on at least one of the two plates (2, 3) on a plate edge in an area of the pocket-shaped recesses (9).

9 Claims, 3 Drawing Sheets

RADIAL FAN WHEEL ARRANGEMENT

CROSS-REFERENCE TO RELATED APPLICATIONS

This application claims priority to German Patent Application 10 2010 011 526.6, filed Mar. 15, 2010

BACKGROUND OF THE INVENTION

The invention relates to a radial fan wheel arrangement consisting of a circular bottom plate and a circular cover plate with a central inflow opening as well as wheel blades, wherein at least one counterweight is mounted on at least one of the two plates in the edge area of the plate.

An arrangement such as this is known, for example, from DE 198 45 501. This arrangement has, however, the disadvantage that disruptive noise is produced at the attached clamp-shaped counterweights as a result of the turbulence occurring at the clamp weights, a noise which is produced by the counterweights in interaction with the resonance volume in a typical installation situation, in particular due to the projecting tongues of the counterweights.

SUMMARY OF THE INVENTION

It is an object of the invention to improve a radial fan wheel arrangement of the kind described above to such an extent that an easy assembly of the counterweights is possible; on the one hand, the counterweights exert as little influence as possible on the flow behavior, so that the counterweights do not cause any additional flow noises.

This is attained according to the invention by configuring pocket-shaped recesses, at least to a limited extent, over one side of the plate surface in the space between the wheel blades in the outermost edge area of the cover plate and/or the bottom plate by reducing the thickness of the plate, and by mounting at least one counterweight or several counterweights in the area of at least one of the pocket-shaped recesses. In this way, the counterweights are mounted at least to a limited extent flush with the respective plate, whereby the flow noises are reduced. An accurate angular position of the counterweights is possible by means of the solution proposed by the invention. A good accessibility for insertion of the counterweights is also achieved.

The invention makes possible a secure hold of the counterweights by providing a constant metal thickness for the area of the pocket-shaped recesses or for the outermost edge area of the cover or bottom plate or both. Already existing counterweights can additionally be utilized. A desirable flow guidance of the flowing air is produced as a result of the recessed or shielded arrangement of the clamp-like counterweights, and in particular by shaping a special thickening of the plate so that the flow of air takes place essentially above the attached counterweights.

BRIEF DESCRIPTION OF THE DRAWINGS

The invention will be described in more detail with reference to the exemplary embodiment depicted in the enclosed drawings, wherein.

DETAILED DESCRIPTION OF A PREFERRED EMBODIMENT

Figure 1:
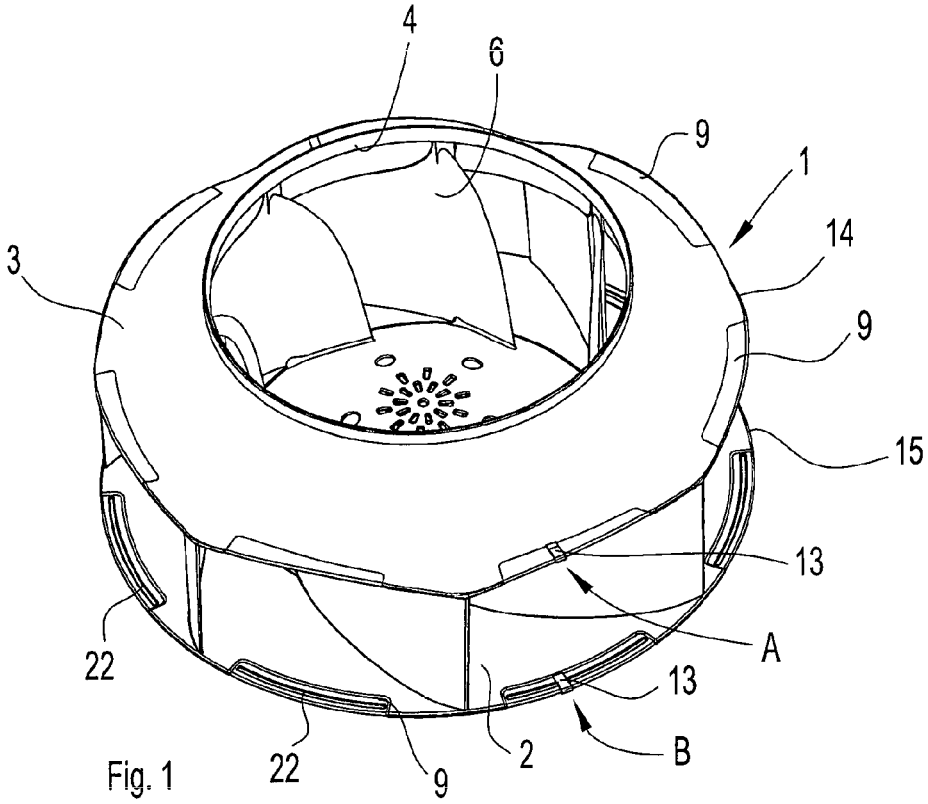
FIG. 1 shows a perspective view of a radial fan wheel arrangement according to the invention.

The same parts are always identified with the same reference numerals in the separate figures of the drawings and are only described once for this reason.

Figure 2:
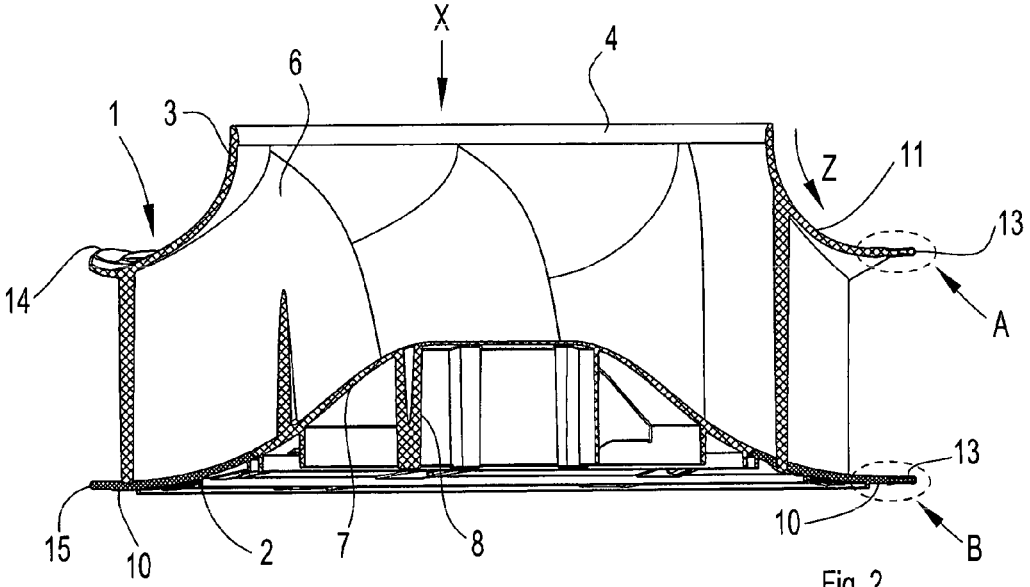
FIG. 2 shows a cross section of the radial fan wheel arrangement of FIG. 1.

As can be seen in FIG. 1, the radial fan wheel arrangement according to the invention consists of a fan wheel 1 having a circular bottom plate 2 and a circular cover plate 3 with a central inflow opening 4. Wheel blades 6 run between the bottom plate 2 and the cover plate 3. As can be seen in FIG. 2, the bottom plate 2 is configured in a pot shape and has a pot-shaped concavity 7 that faces in direction toward the inflow opening 4. A wheel hub 8 is formed in the interior of the concavity 7, which serves for mounting the fan wheel 1 on an electric motor, which is not depicted, in particular an external rotor motor. It is likewise within the scope of the invention to connect the bottom plate 2 in another way to the drive motor so that the fan wheel 1 according to the invention can likewise be operated with an internal rotor motor. The fan wheel 1 is preferably configured as a plastic injection molded part. However, it can likewise be made of metal or a combination of plastic and metal. The cover plate 3 can be shaped with an arcuate cross section, as seen in FIG. 2, so that low flow losses result in an air flow in the direction of arrow X in the region of the cover plate wall. The invention also relates to the fan wheel 1 individually.

Figure 3:
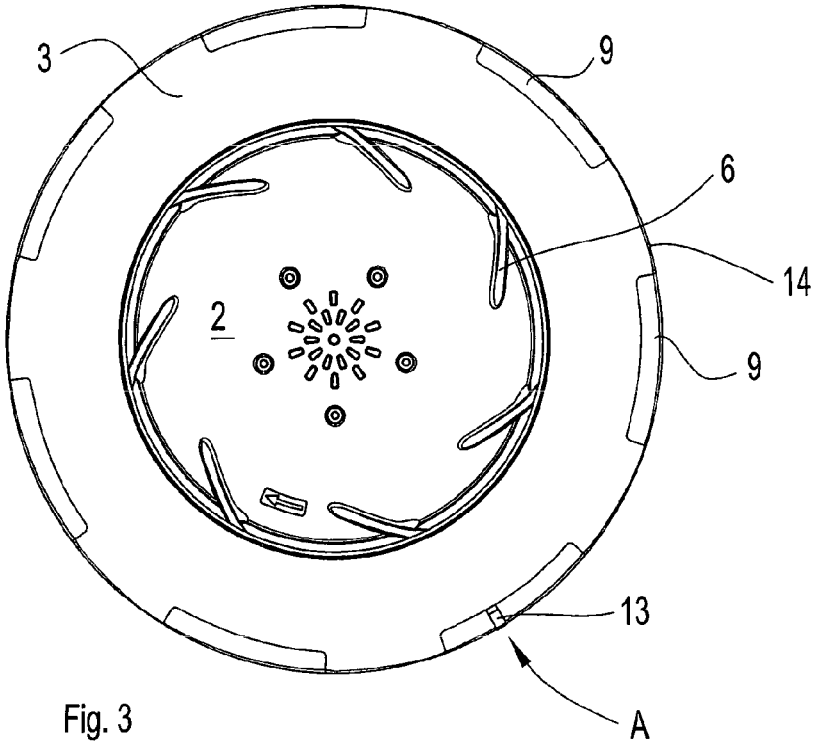
FIG. 3 shows a frontal view of the radial fan wheel arrangement according to FIG. 1.
Figure 4:
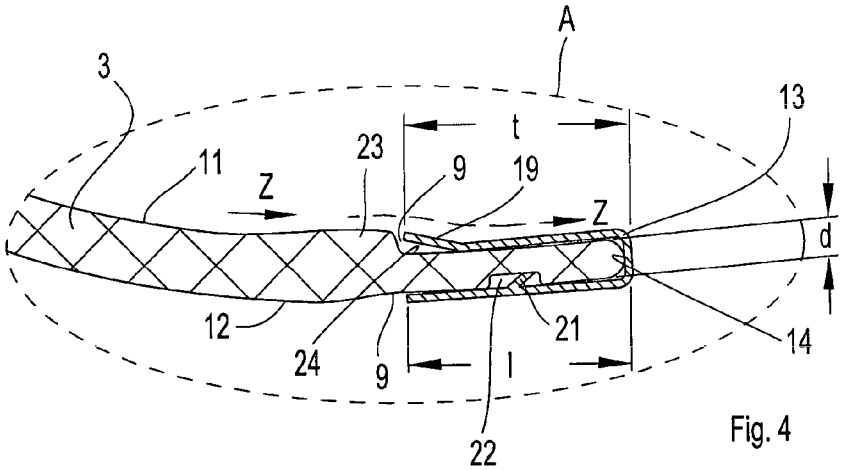
FIG. 4 shows a detail at A in FIG. 2.
Figure 5:
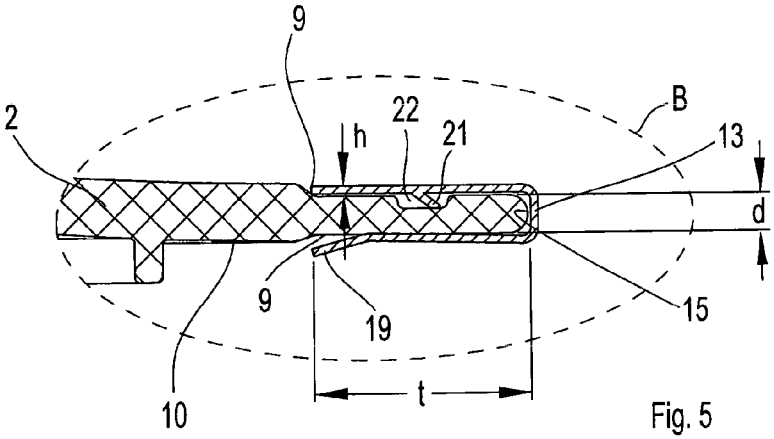
FIG. 5 shows a detail at B in FIG. 2.

As can be seen in detail in FIGS. 1 and 3 as well as in FIGS. 4 and 5, pocket-shaped recesses 9 are configured, at least to a limited extent, over one side of the plate surface in the space between the wheel blades 6 in the outermost edge area of the cover plate 3 and/or the bottom plate 2 by reducing the thickness of the cover plate 3 and the bottom plate 2. These pocket-shaped recesses 9 are advantageously configured respectively on an outer side 10 of the bottom plate 2 or an outer side 11 of the cover plate 3. They can, however, also be advantageously configured on both sides of the bottom plate 2 or of the cover plate 3, or on the bottom plate 2 and the cover plate 3. The pocket-shaped recesses 9 are preferably provided on both sides, meaning the outer side 10 of the bottom plate 2 and the outer side 11 of the cover plate 3. The side that faces toward a flow channel located between the wheel blades 6 is considered herein as the inner side of the cover plate 3.

Figure 6:
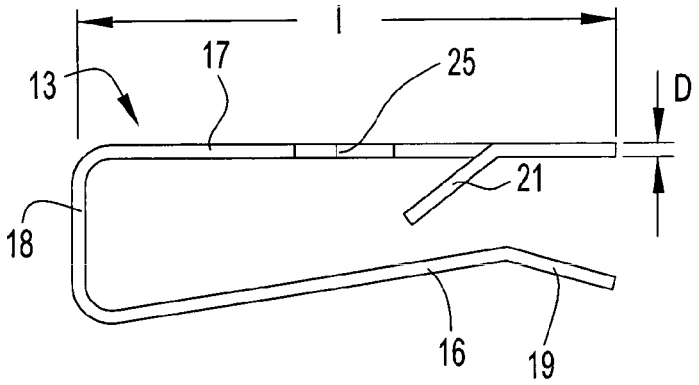
FIG. 6 shows a lateral view of a counterweight according to the invention.
Figure 7:
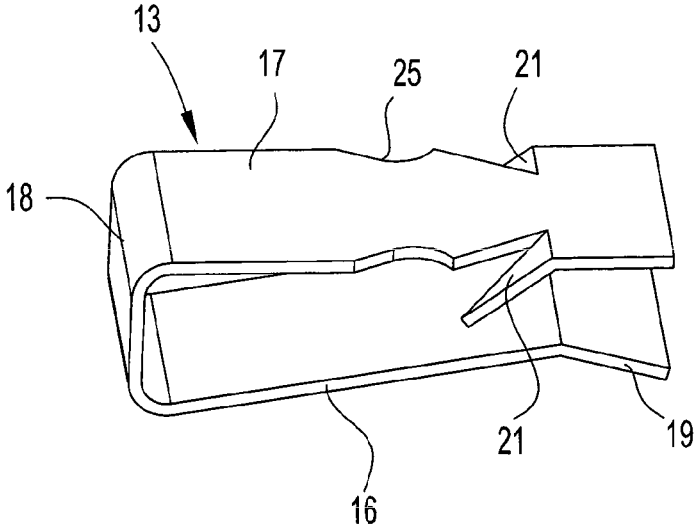
FIG. 7 shows a perspective view of the counterweight of FIG. 6.

A fan wheel arrangement according to the invention comprises in addition at least one counterweight 13, which is arranged in the area of one or several of the pocket-shaped recesses 9 of the cover plate 3 and/or bottom plate 2. The pocket-shaped recesses 9, which are formed by means of a reduction of the plate thickness of the bottom plate 2 or the cover plate 3, extend from an outer edge 14, 15 of the plate in direction toward the center of the bottom plate 2 or the cover plate 3; refer to FIGS. 4 and 5. As can be seen in FIGS. 6 and 7, a counterweight 13 according to the invention consists of an approximately U-shaped curved clamp of spring elastic material, in particular spring steel, with two mutually opposite clamp legs 16, 17, which are connected at one end via an arcuate section 18. The separation of the clamp legs 16, 17 is smaller in the end area of the free ends of the clamp legs 16, 17 than the thickness d of the bottom plate 2 or the cover plate 3 in the outer edge area or in the area of the pocket-shaped recesses 9. A clamping seat of the counterweights 13 on the bottom plate 2 or the cover plate 3 is ensured by the way the counterweight 13 is dimensioned when the counterweight 13 is in position. As can also be seen in FIGS. 6 and 7, it may be practical to provide the end of the leg 16 with a clamping tongue 19 projecting in the sense of an increasing distance with respect to the other leg 17. This embodiment facilitates the positioning of the clamp-shaped counterweight 13 on the same edge or rather the edge of the pocket-shaped recesses 9. We make reference herein in particular to FIGS. 4 and 5. It can also be seen in these figures that it can furthermore be practical to provide the leg 17 arranged opposite to the clamping tongue 19 with mutually opposite locking tongues 21, which face in direction toward the other leg 16 and the arcuate section 18 of the clamp, at its two longitudinal edges. In this connection, we make reference also to FIGS. 6 and 7, which show a clamp-shaped counterweight 13 according to the invention. The cover plate 3 and/or the bottom plate 2 are provided with a retaining notch 22 on their inner side facing toward the flow channel formed between them in the area of the pocket-shaped recesses 9, into which the clamp-shaped counterweight 13 engages with its locking tongues 21 when it is in position, and the counterweight 13 is hereby fixed in radial direction. As can be seen in FIGS. 4 and 5, the locking tongues 21 engage with their free ends behind the inner wall of the retaining notch 22 located in a radially outward position. The height h of the pocket-shaped recesses 9 is advantageously equal to or greater than the thickness D of the clamp legs 16, 17, so that the clamp legs 16, 17 are flush countersunk in the pocket-shaped recess 9, and thus cannot constitute a flow obstacle. It is furthermore advantageous if the radial depth t of the pocket-shaped recesses 9 is equal to or greater than the length l of the clamp legs 16, 17, and the length of the clamp legs 16, 17 is greater than the width of the clamp legs 16, 17. As can be seen especially clearly in FIGS. 2 and 4, an intake flow according to arrow X in FIG. 2 is formed when the fan wheel 1 is rotated, whereupon an air flow Z is also produced, to a limited extent, on the outer side of the cover plate 3. As can be seen in FIG. 4, this outer flow Z in the area of the projecting clamp tongue 19 would lead to turbulence and vibrations of the clamping tongue 19. It is particularly advantageous from the point of view of the invention, for this reason, to configure a thickening 23 on one side of the plate wall over the length of the cover plate 3 in the area ahead of the pocket-shaped recess 9, in such a way that an air flow is guided on the outer side of the plate via the clamping tongue 19 when the counterweight 13 is attached. The height of the thickening 23 with respect to the bottom 24 of the pocket-shaped recess 9 corresponds therein at least to the distance of the free end of the clamping tongue 19 with respect to the bottom 24. As can be seen in FIG. 5, there is no need to configure such a thickening 23 if the counterweight 13 is assembled on the bottom plate 2, since the clamping tongue 19 is located on the flow-free outer side 10 of the bottom plate 2 when the counterweight 13 is attached.

The clamp-shaped counterweight 13 according to the invention is preferably configured as a punched bending part and has a constriction 25 in the area ahead of the locking tongues 21. The flexibility of the clamp leg 17 is increased in this way, so that an easy attachment and rebound of the locking tongues 21 in the retaining notch 22 is facilitated.

Figure 8:
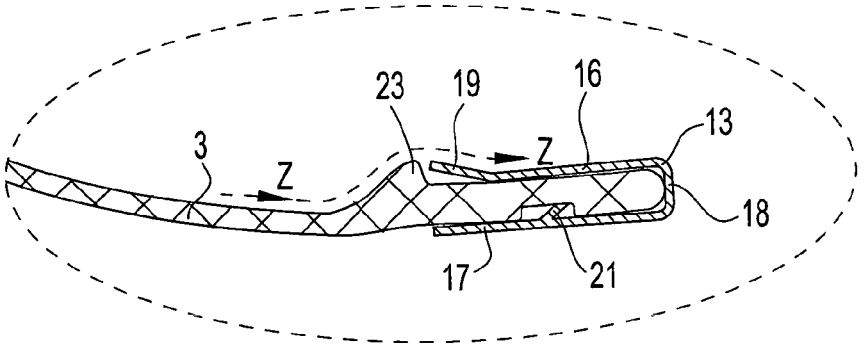
FIG. 8 shows a detail view according to FIG. 4 of another embodiment of the invention.

FIG. 8 shows another embodiment of the invention. In it, the outer edge area of the cover plate 3 has a greater thickness, for example, 1½ to 2½ times the thickness of the remaining area. However, the cover plate 3 can also have a continuously uniform thickness. The counterweight 13, according to the invention, is positioned on the outer edge area of the cover plate 3, so that it engages with its locking tongues 21 in the retaining notch 22. This is configured on one of the pocket-shaped recesses 9 on the inner side 12. The thickening 23, which has a height such that a flow at the outer wall (refer to arrow Z) is guided via the one-sided clamping tongue 19, that is, the height of the thickening 23 corresponds to at least the vertical distance of the end of the clamping tongue 19 from the upper side of the cover plate 3 in the outer edge area of the cover plate 3, is configured on the cover plate 3 ahead of the radially inwardly arranged end of the counterweight 13. The thickening 23 can be configured in the shape of a circular arc between the wheel blades 6, or can also be circular.

The separate features of the embodiment of the fan wheel 1 as well as the counterweight 13 represented in the drawings are not only applicable to the represented combination, but are separately essential to the invention independent of the other embodiment features and can be combined with one or several other embodiment features. The invention further relates to a radial fan wheel without counterweight, as explained in the above embodiment variations, as well as likewise with a single counterweight.

The invention is not limited to the shown exemplary embodiment, but comprises also all of the features that behave, in the same way, in the sense of the invention. The invention thus far is not only limited to the feature combination disclosed in the preferred embodiment, but can also be defined by any other discretionary combination of specific features of all the disclosed individual features. This means that, fundamentally, practically any separate feature of the invention can be omitted or replaced by at least one individual feature disclosed at another location of the application.

The invention claimed is:

1. A radial fan wheel arrangement comprising two circular plates, one of the plates being a bottom plate and the other one of the plates being a cover plate with a central inflow opening, a plurality of wheel blades running between the bottom plate and the cover plate and generating a radially outward airflow between the bottom plate and the cover plate, at least the cover plate having a periphery and a surface with pocket-shaped recesses between the wheel blades along the periphery, the pocket-shaped recesses being formed by a reduced plate thickness of at least the cover plate in a circumferential direction and in a radial direction in locations of the pocket-shaped recesses and extending radially inward from the periphery of at least the cover plate, at least one counterweight mounted on at least the cover plate in an area of at least one of the pocket-shaped recesses, the counterweight including an approximately U-shaped curved clamp of spring-elastic material, with two mutually opposite arranged clamp legs having a thickness, the plate thickness including a thickness reduction by at least the thickness of one of the clamp legs;

the pocket-shaped recesses having a radial depth, and each of the clamp legs having a length, the radial depth being at least as great as the length of one of the clamp legs;

each clamp leg further having a width, the length being greater than the width;

each clamp leg further having a free end and a connected end, the connected ends being connected via an arcuate section, and the free ends in a relaxed stated being spaced apart from each other by a distance smaller than the thickness of the plate in the area of the pocket-shaped recesses;

wherein the cover plate has an outside surface with elevations formed by thickened areas, the thickness reduction extending at least in part on the outside surface radially outward from the thickened areas, and wherein at least one clamping tongue protrudes from the outside surface by a tongue distance, the outside-surface thickness reduction being approximately equal to the tongue distance.

2. The fan wheel arrangement of claim 1, wherein the clamping tongue extends from the free end of at least one of the two clamp legs and is bent in a direction away from the other clamp leg.

3. The fan wheel arrangement according claim 2, wherein one of the clamp legs has a clamping tongue and the other clamp leg has at least one longitudinal edge with a locking tongue extending toward the connected end and bent toward the other clamp leg.

4. The fan wheel arrangement according claim 3, wherein the clamp leg without clamping tongue has two opposite longitudinal edges, each of the edges having a locking tongue.

5. The fan wheel arrangement according to claim 3, wherein at least one of the plates has an inside surface facing toward the other plate with a retaining notch in each of the pocket-shaped recesses, the retaining notch being configured to engage with the locking tongue and to secure the counterweight radially.

6. The fan wheel arrangement according to claim 5, wherein the retaining notch is shaped like a circular arc.

7. The fan wheel arrangement according to claim 3, wherein the counterweight is configured as a punched bending part, the clamp leg with the at least one locking tongue having a constriction of reduced width between the connecting end and the at least one locking tongue.

8. The fan wheel arrangement according to claim 1, wherein the fan wheel is formed as an injection-molded plastic part.

9. The fan wheel arrangement according to claim 1, wherein the cover plate has two opposed surfaces with opposed pocket-shaped recesses.

* * * * *

UNITED STATES PATENT AND TRADEMARK OFFICE

CERTIFICATE OF CORRECTION

PATENT NO. : 8,807,949 B2
APPLICATION NO. : 13/046833
DATED : August 19, 2014
INVENTOR(S) : Christian Hammel et al.

It is certified that error appears in the above-identified patent and that said Letters Patent is hereby corrected as shown below:

On the Title Page

Left column, item (73), after "Assignee:" replace "Emb-Papst Mulfingen GmbH & Co. KG" with –Ebm-Papst Mulfingen GmbH & Co. KG–.

Signed and Sealed this
Sixteenth Day of February, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,807,949 B2
APPLICATION NO. : 13/046833
DATED : August 19, 2014
INVENTOR(S) : Christian Hammel et al.

It is certified that error appears in the above-identified patent and that said Letters Patent is hereby corrected as shown below:

TITLE PAGE:

"Left column, item (73), after "Assignee:" replace "Emb-Papst Mulfingen GmbH & Co. KG" with –Ebm-Papst Mulfingen GmbH & Co. KG–." (as corrected to read in the Certificate of Correction issued February 16, 2016) is deleted and patent is returned to its original state with the applicant & assignee name in patent to read -- Emb-Papst Mulfingen GmbH & Co. KG, Mulfingen (DE) --

Signed and Sealed this
Thirty-first Day of May, 2016

Michelle K. Lee

Michelle K. Lee
*Director of the United States Patent and Trademark Office*